US006369308B1

(12) United States Patent
Orr

(10) Patent No.: US 6,369,308 B1
(45) Date of Patent: Apr. 9, 2002

(54) PERCUSSION INSTRUMENT PEDAL ASSEMBLY

(76) Inventor: Mark Anthony Orr, 101 Mayona Road, Montmorency, Vic 3094 (AU)

( * ) Notice: Subject to any disclaimer, the term of this patent is extended or adjusted under 35 U.S.C. 154(b) by 0 days.

(21) Appl. No.: 09/711,365

(22) Filed: Nov. 9, 2000

(30) Foreign Application Priority Data

May 19, 2000 (AU) ..... PQ7599

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS 980,488 A * 1/1911 Carney ..... 84/422.1
1,154,120 A * 9/1915 Kendrick ..... 84/422.1
1,343,163 A * 6/1920 Smith ..... 84/422.1
1,496,456 A * 6/1924 Faria ..... 84/422.1
1,604,945 A * 10/1926 Rohr ..... 84/422.1
3,967,523 A * 7/1976 Cunier et al. ..... 84/422.1
4,958,607 A * 9/1990 Lundberg ..... 123/399
6,166,312 A * 12/2000 Brewster et al. ..... 84/422.1

* cited by examiner

*Primary Examiner*—Shih-Yung Hsieh
(74) *Attorney, Agent, or Firm*—Flanagan & Flanagan; John R. Flanagan

(57) ABSTRACT

A percussion instrument pedal assembly includes a base, a shaft, a footplate, a bearing and a spring. The shaft at one end is pivotally mounted to the base and near the other end able to be connected to a percussive striker for striking a percussion instrument. The footplate has a toe end and an opposite heel end pivotally mounted on the base remote from the shaft. The bearing is connected to the footplate adjacent its toe end and has a rotating member able to engage the shaft adjacent the toe end of the footplate such that depression of the footplate will move the shaft in a first direction to cause the percussive striker to strike the percussion instrument when the percussive striker is connected to the shaft. The spring is biased to move the shaft in a second direction opposite the first direction upon release of the footplate.

15 Claims, 1 Drawing Sheet

PERCUSSION INSTRUMENT PEDAL ASSEMBLY

FIELD OF THE INVENTION

This invention relates to a pedal assembly for striking a musical percussion instrument. It is particularly for use as a base drum pedal assembly, but is not limited to such use.

BACKGROUND OF THE INVENTION

A foot pedal is used for musical instruments including a bass drum of a drum set high-hats and other percussive instruments. Bass drum pedals have been used for decades to play the drums and these pedals have been played manually and generally all include an indirect rotation mechanism of a beater. Other percussive instruments may also use a beater or use other striking means such as two cymbals striking each other as in high-hats.

A foot pedal, used for the bass drum of a drum set, is designed to rotate a beater in accordance with foot pressure applied to a foot board so that the drum head of the bass drum is beaten by the beater. In order to stabilise the operation of the foot pedal, the conventional foot pedal is constructed in accordance with one of three general constructions described as follows:

In a first construction a connection rod interconnects a frame member, which rotatably supports a shaft axis of a beater member to a heel member which supports a back edge portion of a foot board. In a second construction a base plate is provided between the frame member and the heel member so that the frame member is attached to the base plate by screws. In a third construction the above-mentioned first and second constructions are combined as disclosed in U.S. Pat. No. 4,538,499.

However in addition to the fast changes of a music performance these days, the performance technique using the foot pedal must be substantially changed. In making such changes a conventional foot pedal constructed in accordance with the above-mentioned constructions cannot respond well. In the first foot pedal construction the foot board is stepped on during the performance, but the heel member may be somewhat elevated. Since the frame member and heel member are connected by the connection rod only, it is difficult to maintain the positional relationship between them. Therefore, it is impossible to stabilise the beat timing and beating strength in response to the step-on operation of the foot board.

The second foot pedal construction has the disadvantage of employing the so-called double-sided single point supporting structure by which the frame member is attached to the base plate. Due to such structure, the frame member may be rotated with the base plate about the supporting point, which is an unstable construction.

In the third construction, which is the combination of the first and second countermeasures, the connection rod cannot reinforce the strength of the connection between the frame member and base plate effectively. With such relatively weak reinforcement, the third construction requires an increase in the number of the required parts. As described before, since the bass drum is disposed within the drum set in an inclined manner, there is a possibility that the base plate will be subjected to bending deformation.

The foot pedal of U.S. Pat. No. 5,458,038 to Kurosaki attempts to overcome these stability shortfalls by having a rocker to which the beater is connected. The rocker is mounted on a vertical frame member for rotation in a vertical plane. A chain extends from the end of the foot plate and around the rocker such depression of the toe end of the foot plate rotates the rocker and allows the beater to strike the drum.

It can therefore be seen that a rotative force is always needed. Also manual operation has always been used with a spring to recoil the pedal to the start or up-position after the pedal has been played down to the end position by the player. This recoil is independent of the pedal and therefore a further recoil can occur upon reaching the start or up-position resulting in unwanted re-hitting of the drum. Therefore, the ability to play the pedal has always been controlled by the resistive spring action and the associate moving parts of the pedal. In order to play the beater with more force it is necessary to have a greater pedal force and therefore a greater resistive spring action. However, this increases the chance of multiple recoils and therefore multiple unwanted hits of the drum. U.S. Pat. No. 6,075,191 to Scire attempts to improve the hard playing of a bass drum by providing a power assisted drum pedal but this requires a complex array of belts and wheels to create lever actions.

BRIEF SUMMARY OF THE INVENTION

In accordance with the invention there is provided a percussion instrument pedal assembly comprising:

a shaft mounted to a base at one end and at or near the other end able to be connected to a percussive striker such as a beater or movable part of the percussion instrument for striking a receiving part of the percussion instrument to create a sound;

a footplate;

a bearing, means connected to the shaft or the footplate and able to engage the other such that depression of the footplate will move the shaft in a first direction and when connected able to cause the percussive striker to strike the percussion instrument; and a resilient means tending to move the shaft in a second direction opposite to the first direction.

The pedal assembly can have a linear shaft or be curved or a combination. Preferably the shaft is curved away from the footplate.

The footplate can be pivotally mounted at a heel end of the footplate with the bearing means mounted adjacent to a toe end of the footplate. The bearing means can comprise a rotating member able to engage between a toe end of the footplate and the shaft. In one form the rotating member is mounted on the toe end of the footplate and a ball bearing or rotating wheel is mounted at the other end able to engage the shaft.

The resilient means can in one form comprise a retraction means such as a spring extending between the shaft and a base portion near the foot pedal. In another form, the resilient means comprises a compression means on the other side of the shaft from the foot pedal. In a still further form the resilient means comprises the shaft being formed of resilient material which tends to return to an initial position.

The invention also provides a percussion instrument pedal assembly comprising a base plate able to engage the floor; a foot plate substantially overlying the base plate and pivotally mounted to the base plate at or near one end; an angled shaft pivotally mounted near the distal end of the foot plate; an extension means extending from the distal end of the foot plate and having a bearing means able to engage the shaft; wherein in a normal inactive position the bearing means at least partially overlies a portion of the shaft and upon depression of the foot plate the bearing means deflects the shaft such that a percussion instrument striking means connected to the free end of the shaft can strike the percussion instrument and the shaft cannot return to the normal inactive position until the foot plate is allowed to rise.

The direct linear motion is a key factor in the innovative design principle of this base drum pedal, unique to any other pedal providing a sound from a base drum.

The function of the design is to provide the application of a beater hitting against the drum head or skin of a base drum or cause a percussive action on other musical instrument movement of a human foot. This generation of movement described provides a sound known as a beat in the form of musical note, that cannot be denied.

By pressing down on the foot plate, the pivoting motion of the foot plate in a downward movement forces the contact on the bearing surfaces between the bearing and linear shaft and creates a forward motion due to pivoting at the bottom end of the linear shaft. The surface of the footplate bearing is forced to run down along the curved shaft to provide a greater length of movement forward by the beater to the length travelled by the bearing down the surface of the linear shaft. This provides a much greater strength at which the beater can be applied to the surface of the percussive instrument such as the drum skin or head or force applied to other percussive instrument and thereby providing a louder audible note.

BRIEF DESCRIPTION OF THE DRAWINGS

The present invention will be more fully understood by reference to the enclosed drawing which is illustrative of the invention wherein.

DESCRIPTION OF THE BEST METHOD OF PERFORMING THE INVENTION

Figure 1:
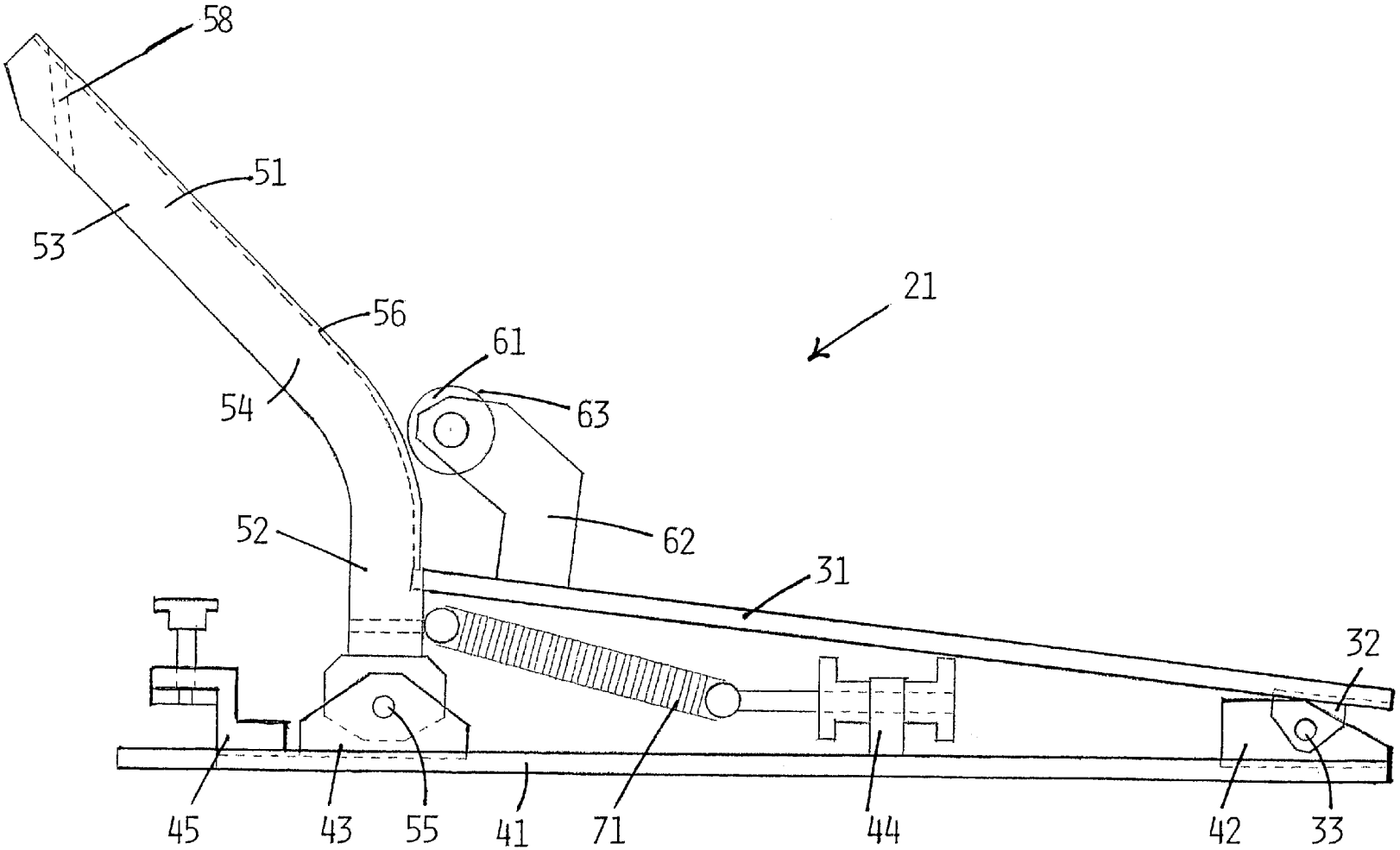
FIG. 1 is a side elevation of a percussion instrument pedal assembly in accordance with the invention.

Referring to the drawings there is shown a percussion instrument pedal assembly particularly for use as a base drum pedal. The assembly 21 includes a footplate 31 and a linear baseplate 41 which has a shaft 51 mounted at one end for holding a beater (not shown) and connected in a way to provide a forward motion of the beater to strike the head of a drum skin upon downward movement of the footplate 31.

The linear baseplate 41 is able to engage and lie on a floor. The linear footplate 31 is mounted to the baseplate 41 near a respective one end such that the footplate 31 substantially overlies the baseplate 41. The mount is by hinge means including footplate flanges 32 extending from an under portion of the footplate 31 pivotally connected by pivot pin 33 to end mount flanges 42 extending from the baseplate 41 towards the footplate 31 and adjacent the footplate flanges 32. The hinge thereby provides an opening and closing motion between the baseplate 41 and footplate 31.

The shaft 51 is formed by linear first and second portions 52 and 53 connected therebetween by a curved portion 54 to form a bent shaft that extends in a single plane. The first portion 52 is mounted to the baseplate 41 in an initial relative rectilinear position at the bottom end of its length at its top end and curving away from the footplate 31 and in use towards the percussion instrument. The second portion 53 of the shaft 51 includes a channel 58 for holding the handle of a beater (not shown). Depending on the percussion instrument and the type of music being played various types of beaters can be mounted into the shaft to provide different effects including loudness when striking the percussion instrument such as the bass drum.

The mounting of the shaft 51 on the baseplate 41 is by means of opposing bearing housings forming a shaft mount 43 fixed to the baseplate 41 and receiving fixed pivot arms 55 extending from opposing sides of the end of the first portion 52 of the shaft 51. This provides the shaft 51 with a fixed pivot point enabling a reciprocating pivoting movement co-planar to the pivoting movement of the footplate 31 relative to the baseplate 41.

The shaft 51 is also hollowed out from the end of the first portion 52 pivotally connected to the base plate 41 to nearly three quarters of the length of the shaft 51. In this way the centre of gravity is near the end of the shaft 51 holding the beater. This provides a better top heavy feel to shaft 51 to allow better musicality in striking the percussion instrument.

The shaft 51 further has a bearing surface 56 of a hard compound rubber strip insert fitted down the side of the shaft facing the footplate 31.

A bearing means 61, that is the contacting means between the footplate and linear shaft, is mounted on the upper end of the footplate 31 distal from the hinged end of the footplate 31. The bearing means 61 is a ball bearing having an outer bearing contact surface 63 which is captured in its own housing 62 fixed to the footplate 31. The footplate 31 is sized and the housing 62 is sized and angled from a top surface of the footplate 31 towards the shaft 51 to allow the ball bearing surface 63 to engage the bearing surface 56 of the shaft 51. In this way depression of the footplate 31 will move the shaft 51 in a first direction providing the forward motion of the shaft 51 that clamps the beater (not shown) towards the surface of the drum head.

A resilient means 71 in the form of a spring tends to move the shaft 51 in a second direction opposite to the first direction and returning the beater away from the drum head and back to its initial position. One end of the spring 71 is connected to the first portion 52 of the shaft 51 below the bearing surface 56 and extends beneath the footplate 31 and is connected at the other end to a spring mount 44 fixed to a mid-portion of the baseplate 41. The spring mount includes adjustment means to allow variations in the strain on the spring 71 and thereby adjust the returning force of the shaft 51 to the initial relative rectilinear position. The adjustment also provides different tension settings of the rotation of the shaft 51 required by each individual using the pedal assembly 21.

In use the forward movement of the shaft 51 is provided by the downward movement of a human foot applying pressure to the footplate 31. Return of the footplate 31 and linear shaft 51 to its starting point is provided by the return spring 71. At the front of the baseplate 41 a clamp 45 mounts the pedal assembly 21 to the base drum.

The above described preferred embodiment is illustrative and not restrictive. Clearly the invention can be practiced or embodied in other ways without departing from the spirit or essential character of the invention. For example, the preferred embodiment is described in terms of a food pedal for a bass drum and having a single beater. However, the fundamental construction of the present invention can be applied to other pedals for the drum set such as twin-beater type pedal, side pedal or double pedal where both left and right feet are required. Further, the invention can be adapted for high-hats where the shaft is connected to an upper cymbal spaced from a lower cymbal such that depression of the food pedal cause the upper cymbal to strike the lower cymbal.

The scope of the invention is therefore indicated by the appended claims and all variations which come within the meaning of the claims are intended to be included therein.

What is claimed is:

1. A percussion instrument pedal assembly comprising:

a base;

a shaft having opposite ends, the shaft at one of the opposite ends being mounted to the base and at or near the other of the opposite ends able to be connected to a percussive striker for striking a receiving part of a percussion instrument to create a sound;

a footplate having a toe end and a heel end and being pivotally mounted at the heel end of the footplate;

a bearing means connected to the footplate adjacent the toe end of the footplate and comprising a rotating member able to engage between the toe end of the footplate and the shaft such that depression of the footplate will move the shaft in a first direction and to cause the percussive striker to strike the percussion instrument when the percussive striker is connected thereto; and a resilient means tending to move the shaft in a second direction opposite to the first direction.

2. A pedal assembly in accordance with claim 1 wherein the shaft is linear.

3. A pedal assembly in accordance with claim 1 wherein the shaft is curved.

4. A pedal assembly in accordance with claim 3 wherein the shaft is curved away from the footplate.

5. A pedal assembly in accordance with claim 1 wherein the rotating member is mounted on the toe end of the footplate and is a ball bearing or rotating wheel able to engage the shaft.

6. A pedal assembly in accordance with claim 1 wherein the resilient means comprises a retraction means extending between the shaft and a portion of the base near the footplate.

7. A pedal assembly in accordance with claim 1 wherein the resilient means comprises the shaft being formed of resilient material which tends to return to an initial position.

8. A percussion instrument pedal assembly comprising:

a base;

a shaft having opposite ends, the shaft at one of the opposite ends being mounted to the base and at or near the other of the opposite ends able to be connected to a percussive striker for striking a receiving part of a percussion instrument to create a sound, the shaft being structured such that the longitudinal centre of weight is closer the other of the opposite ends able to be connected to the percussive striker so as to provided a weighted feel;

a footplate;

a bearing means connected to the shaft or the foolplate and able to engage the other such that depression of the footplate will move the shaft in a first direction and when connected able to cause the percussive striker to strike the percussion instrument; and a resilient means tending to move the shaft in a second direction opposite to the first direction.

9. A pedal assembly in accordance with claim 8 wherein the shaft has a hollow section extending from the one of the opposite ends mounted to the base.

10. A percussion instrument pedal assembly comprising:

a base plate able to engage a floor and having one end and a distal end;

a foot plate substantially overlying the base plate and pivotally mounted to the base plate at or near the one end;

an angled shaft pivotally mounted near the distal end of the foot plate; and an extension means extending from the distal end of the foot plate and having a bearing means comprising a rotating member able to engage the shaft;

wherein in a normal inactive position the bearing means at least partially overlies a portion of the shaft and upon depression of the foot plate the bearing means deflects the shaft such that a percussion instrument striking means connected to a free end of the shaft can strike a percussion instrument and the shaft cannot return to the normal inactive position until the foot plate is allowed to rise.

11. A pedal assembly in accordance with claim 10 having the extension means and the bearing means shaped and positioned such that the bearing means remains in contact with the shaft at all times during a striking of the percussion instrument and return to the inactive position.

12. A pedal assembly in accordance with claim 11 including a resilient means connected between the base plate and the shaft tending to return the shaft after striking motion back to the inactive position.

13. A percussion instrument pedal assembly comprising:

a base;

a shaft having a lower end mounted to the base and an outer end able to be connected to a percussive striker for striking a receiving part of a percussion instrument to create a sound, the shaft having a curved portion between the lower end and the outer end, the curved portion presenting a convex bearing surface facing away from the percussion instrument in use;

a foot plate having a toe end and a heel end, the foot plate being pivotally mounted at the heel end for pivotable movement relative to the base;

a bearing means connected to the foot plate remote from the heel end and located to engage the convex bearing surface of the shaft so that depression of the foot plate to rotate the foot plate about its pivotally mounted heel end causes the bearing means to travel along the convex bearing surface to move the shaft in an operative direction to cause the percussive striker to strike the percussion instrument when the percussive striker is connected thereto; and a resilient means urging the shaft in a return direction opposite to said operative direction.

14. A pedal assembly is accordance with claim 13 wherein the bearing means comprises a rotary member to engage and to move along the convex bearing surface with a rolling contact.

15. A pedal assembly in accordance with claim 13 wherein the bearing surface comprises a hard insert fitted to the curved position of the shaft and facing away from the percussion instrument and against which the bearing means engages to travel therealong.

* * * * *